US006148613A

United States Patent [19]

Klopp et al.

[11] Patent Number: 6,148,613

[45] Date of Patent: Nov. 21, 2000

[54] REVERSING FLOW CATALYTIC CONVERTER FOR INTERNAL COMBUSTION ENGINE

[75] Inventors: Gerhard O. Klopp; Edward Mirosh; Ming Zheng, all of Calgary, Canada

[73] Assignee: Alternative Fuel Systems, Inc., Calgary, Canada

[21] Appl. No.: 09/404,019

[22] Filed: Sep. 23, 1999

Related U.S. Application Data

[63] Continuation of application No. 09/176,354, Oct. 21, 1998, abandoned.

[51] Int. Cl.[7] ..... F01N 3/00

[52] U.S. Cl. ..... 60/296; 60/287; 60/292; 60/299; 60/309; 60/324; 210/425; 210/426; 137/625.43

[58] Field of Search ..... 60/287, 288, 289, 60/292, 297, 296, 309, 324, 274, 299, 301, 295; 137/625.43; 210/425, 426

[56] References Cited

U.S. PATENT DOCUMENTS

| | | | |
|---|---|---|---|
| 3,172,251 | 3/1965 | Johnson . | |
| 3,189,417 | 6/1965 | Houdry et al. . | |
| 3,607,133 | 9/1971 | Hirao et al. | 23/288 |
| 3,962,869 | 6/1976 | Wössner | 60/298 |
| 4,047,895 | 9/1977 | Urban | 23/288 |
| 4,139,355 | 2/1979 | Turner et al. . | |
| 4,969,328 | 11/1990 | Kammel | 60/275 |
| 5,585,005 | 12/1996 | Smith et al. | 210/703 |
| 5,701,735 | 12/1997 | Kawaguchi | 60/274 |
| 5,768,888 | 6/1998 | Matros et al. | 60/274 |

FOREIGN PATENT DOCUMENTS

| | | |
|---|---|---|
| 2246715 | 12/1992 | United Kingdom . |
| WO 95/23917 | 9/1995 | WIPO . |
| WO 97/03277 | 1/1997 | WIPO . |
| WO 98/20238 | 5/1998 | WIPO . |

OTHER PUBLICATIONS

RFC, "Gasoline Direct Injection and Diesel Aftertreatment", SAE SSP–1470, pp. 103–109, Dec. 1999.

Stuart R. Bell Emissions, "Fuels and Lubricants and HSDI Engine", ICE–vol. 33–1, p. 102, Oct. 1999.

Zeng et al., A Novel Reverse–Flow Catalytic Converter Operated on an Isuzu–6HH1 Diesel Dual Fuel Engine, p. 101, Dec. 1999.

*Primary Examiner*—Thomas Denion
*Assistant Examiner*—Binh Tran
*Attorney, Agent, or Firm*—Hardaway/Mann IP Group

[57] ABSTRACT

A compact reversing flow catalytic converter for reducing noxious substances in exhaust gases produced by internal combustion engines is described. The catalytic converter includes a valve unit which reversibly directs exhaust gases through a container filled with catalytic material. The container defines a U-shaped gas passage which communicates with two ports at a top of the container. The valve unit is mounted to the top of the container and includes an intake and an exhaust cavity. The valve unit includes a valve disk having two openings therethrough and rotates around a perpendicular central axis between a first and second position. In each position, each opening communicates only with one of the cavities and one of the ports. In the first position, the exhaust gases enter the exhaust cavity from an exhaust pipe and pass through one of the openings into the gas passage where they contact the catalytic material as they travel through the U-shaped gas passage and enter the exhaust cavity. In the second position, the two openings are rotated 90° so that each opening communicates with the same cavity but a different one of the ports. Therefore, the gas flow through the U-shaped gas passage is reversed. The advantage is a compact, reliable, highly-efficient catalytic converter that is inexpensive to manufacture.

25 Claims, 9 Drawing Sheets

REVERSING FLOW CATALYTIC CONVERTER FOR INTERNAL COMBUSTION ENGINE

RELATED APPLICATIONS

This application is a continuation of U.S. patent application Ser. No. 09/176,354 filed Oct. 21, 1998 and now abandoned.

TECHNICAL FIELD

The present invention relates to internal combustion engines and, in particular, to a reversing flow catalytic converter for treating exhaust gases from an internal combustion engine.

BACKGROUND OF THE INVENTION

Internal combustion engines can be powered with a variety of fuels such as gasoline, diesel fuel, natural gas, liquid petroleum gas, or fuel mixtures such as gasoline/methanol or gasoline/ethanol. Dual fuel engines have also been invented which use diesel/natural gas or diesel/propane fuels, for example. Internal combustion engines produce large quantities of exhaust gases consisting primarily of carbon dioxide, water, nitrogen, oxygen, partially combusted and uncombusted hydrocarbons, carbon monoxide and oxides of nitrogen. It is well known in the art to employ an exhaust gas converter containing an oxidation catalyst to treat exhaust gases in order to reduce the concentrations of pollutants such as uncombusted hydrocarbons, and noxious by-products. However, in order to efficiently oxidize pollutants in exhaust gases, the catalyst must operate at high temperatures. Conventional converters therefore exhibit poor conversion efficiency at low engine loads due to low exhaust temperatures. This leads to increased exhaust emissions during low load operation, especially for the non-reactive hydrocarbons, specifically, methane. When a diesel engine is idling and the exhaust gas temperature falls below 300° C., emission reduction in the catalytic converter is lessened because the temperature of the exhaust gases is cooler than the light off/ignition temperature of the catalyst. This is particularly a problem when the engine is a dual fuel engine powered by a diesel fuel/methane mixture. To overcome this problem, reversing flow catalytic converters have been invented.

A reversing flow catalytic converter works on a principle of periodically redirecting engine exhaust through a catalyst in alternate directions. The duration of flow in each direction is determined by engine operating conditions. The goal is to obtain an ideal temperature profile throughout the catalytic material in the catalytic converter. For example, in a PCT patent application PCT/US97/19928, which was published on May 14, 1998. Matros et al. discloses a method and a system in which exhaust gases in contact with a gas permeable solid material containing an adsorbent and a catalyst capable of converting noxious components in the exhaust gases into innocuous substances. The flow of gases through the gas permeable solid material is reversed in a series of continuing cycles to bring, or to maintain, the catalyst in a temperature range suitable for oxidizing the noxious components. Below that temperature range the noxious components are adsorbed by the adsorbent. One embodiment described in this application comprises four valves working co-operatively to achieve the full reversing function. A disadvantage of this embodiment is that the structure is bulky because of the required plumbing and valving.

In a second embodiment, reversing the flow of the exhaust gases through gas permeable solid material is achieved by axially rotating the solid material while the gas flow direction through inlet and outlet ports remains unchanged. Rotating of the solid material moves the material from a first heat exchange zone to a second heat exchange zone in a repetitive cycle. The gas permeable solid material has a plurality of parallel axial channels and the exhaust gases are passed through one section of the channels in a first direction and then are passed through another section of the channels in the opposite direction. The catalyst is preferably applied to the surface of substantially all channels in the rotating element adjacent to an inlet and an outlet for receiving and discharging the exhaust gases. The adsorbent is applied to the surface of substantially all channels adjacent to a space where the exhaust gases change direction of movement.

In a third embodiment, the rotating element is cylindrical and has a hollow central interior. A plurality of radial channels communicate with the hollow central interior. Those channels provide gas passages from a lateral side of the rotating element adjacent to an inlet port to the hollow central interior, and from the hollow central interior to the other side of the rotating element adjacent to an outlet port. The catalyst is applied to the outer portions of the cylindrical element. An adsorbent is applied to the inner portion adjacent to the hollow central interior. Both the second and third embodiments require the rotation of substrates to which the catalysts are applied, rather than changing the direction of the gas flow.

A disadvantage of each of the structures described by Matros et al is that they are not compact. For example, in the second embodiment a closed compartment 21 is required at one end of the first and second heat exchange zones to provide a stationary passageway for gas flow from the moving channels in the first heat exchange zone to the moving channels in the second heat exchange zone (FIG. 6). Furthermore, the reliability of performance is compromised because of the rotating structure.

Instead of using four co-ordinated valves to control the reversal of gas flow, or a rotating substrate structure, a four-way valve provides a more reliable structure for reversing flow converters. In a paper entitled "Novel Catalytic Converter for Natural Gas Powered Diesel Engines to Meet Stringent Exhaust Emission Regulations" which was published in the Proceedings of NGVs Becoming a Global Reality, International Conference and Exhibition for Natural Gas Vehicles, May 26–28, 1998, Cologne, Germany. Zheng et al describe a catalytic converter which has a four-way valve to switch the direction of a reversing gas flow. The four-way valve is a universal valve, structurally independent of the converter and directs flow radially. Therefore, the plumbing required for the converter makes the system quite bulky.

Another converter structure is described by Houdry et al. in U.S. Pat. No. 3,189,417 which issued on Jun. 15, 1965, and is entitled "Apparatus for Improving the Purification of Exhaust Gases from an Internal Combustion Engine". This patent discloses a reversing flow converter which has a bed of oxidation catalyst pellets confined between two layers of heat exchange material. A four-way valve is incorporated in the converter. When the valve is rotated 90°, the direction of the gas flow is changed from passing downwardly through the catalyst bed and heat exchange material to passing upwardly through the bed in an opposite direction. This arrangement of a bed of oxidation catalyst pellets separate from the heat exchange material is not efficient and conversion performance is poor. Also, because of the structure of flow passages and the manner in which the valve is incorporated in the structure, the structure is not compact.

As a further example, a four way valve construction is taught in U.S. Pat. No. 4,139,355 which issued to Turner et al on Feb. 13, 1979 and is entitled "Four Way Valve For Reversible Cycle Refrigeration System". This patent discloses a four way valve assembly in which a rotary valve accomplishes switching between heating and cooling modes. The rotary valve is mounted in a cavity in a housing and is designed to be rotated by a unidirectional electric motor. The rotary valve comprises a rotating plate having a pair of recesses in it. Each recess provides fluid communication between a pair of ports in a base plate. In order to balance the high pressure acting on one side of the rotating plate, a high pressure bypass port is provided to balance the pressure in the cavity. A cam and switch arrangement provides the necessary control to stop and start the electric motor. This rotary valve, however is not suitable for use in a reversing flow catalytic converter due to its structure. In particular, all four ports are located in the base plate.

The concept of the reversing flow catalytic converter has been demonstrated to be sound and to contribute to reduced exhaust emission levels. However, modern vehicle design demands compact, efficient and mechanically reliable components. Each of the prior art catalytic converter structures described above fail to meet at least one of these criteria.

SUMMARY OF THE INVENTION

It is an object of the present invention to provide a reversing flow catalytic converter system for treating exhaust gases from an internal combustion engine, which system includes a compact valve structure incorporated in the converter.

Another object of the present invention is to provide a reversing flow catalytic converter system for treating exhaust gases from internal combustion engine, which system has a compact structure for efficient performance, minimal heat loss and mechanical simplicity.

Yet another object of the present invention is to provide a four way valve for a reversing flow catalytic converter, which valve overcomes the shortcomings of the prior art discussed above.

According to one aspect of the present invention, there is provided a valve structure for a reversing flow catalytic converter for exhaust gases, the converter including a container with a top end having a first port and a second port which are in fluid communication with each other so that the exhaust gases introduced into either of the first or second ports flow through a catalytic material in the container, comprising:

a valve housing that includes an intake cavity and an exhaust cavity, and is adapted to be mounted to the top end of the container, the valve housing being adapted for connection of an exhaust gas pipe and a tail pipe so that the exhaust pipe communicates with the intake cavity and the tail pipe communicates with the exhaust cavity;

a valve component for reversing gas flow operably mounted in the valve housing and adapted to be moved between a first position in which the intake cavity communicates with the first port and the exhaust cavity communicates with the second port and a second position in which the intake cavity communicates with the second port and the exhaust cavity communicates with the first port.

According to another aspect of the present invention, there is provided a catalytic converter for treating exhaust gases from an internal combustion engine using a catalytic converter comprising:

a container having a gas flow passage therein and a top end having a first port and a second port which respectively communicate with the gas flow passage;

a catalytic material in the gas flow passage adapted to contact the exhaust gases which flow through the passage;

a valve for reversing the gas flow including:

a valve housing that includes an intake cavity and an exhaust cavity mounted on the top end of the container, the valve housing being adapted for connection between an exhaust gas pipe and a tail pipe so that the exhaust pipe communicates with the intake cavity and the tail pipe communicates with the exhaust cavity;

a valve component for reversing gas flow operably mounted in the valve housing and adapted to be moved between a first position in which the intake cavity communicates with the first port and the exhaust cavity communicates with the second port, and a second position in which the intake cavity communicates with the second port and the exhaust cavity communicates with the first port.

Preferably, the valve housing has an interior cavity with an open bottom and a transverse wall that divides the cavity into two halves which respectively form the intake cavity and the exhaust cavity. The valve component may include a plate which is rotatably mounted to the valve housing at the open bottom, and rotates about a central axis that is perpendicular to the plate, the plate having a first opening and second opening therethrough which communicate respectively with each of the ports, and one of the intake and exhaust cavities.

More preferably, the gas flow passage is formed within an interior chamber of the container, the interior chamber being separated by a transverse plate into two parts which respectively form a first chamber section and a second chamber section. The two chamber sections communicate with each other, and each of the chamber sections communicates with one of the first and second ports. The container further comprises a gas permeable material which contains the catalytic material. The gas permeable material preferably comprises a plurality of monoliths having a plurality of cells extending therethrough, the monoliths being coated with a catalytic material.

BRIEF DESCRIPTION OF THE DRAWINGS

Advantages of the valve and the catalytic converter according to the present invention will now be further explained by way of example only and with reference to the accompanying drawings in which:

FIG. 1 is a bottom plan view of a valve housing taken along line 3—3 of FIG. 2 with the valve disk removed, showing a position of a transverse wall which separates an interior cavity of the valve housing;

DETAILED DESCRIPTION OF THE PREFERRED EMBODIMENTS

The present invention relates to a reversing flow catalytic converter for treating exhaust gases from internal combustion engines.

Figure 1:
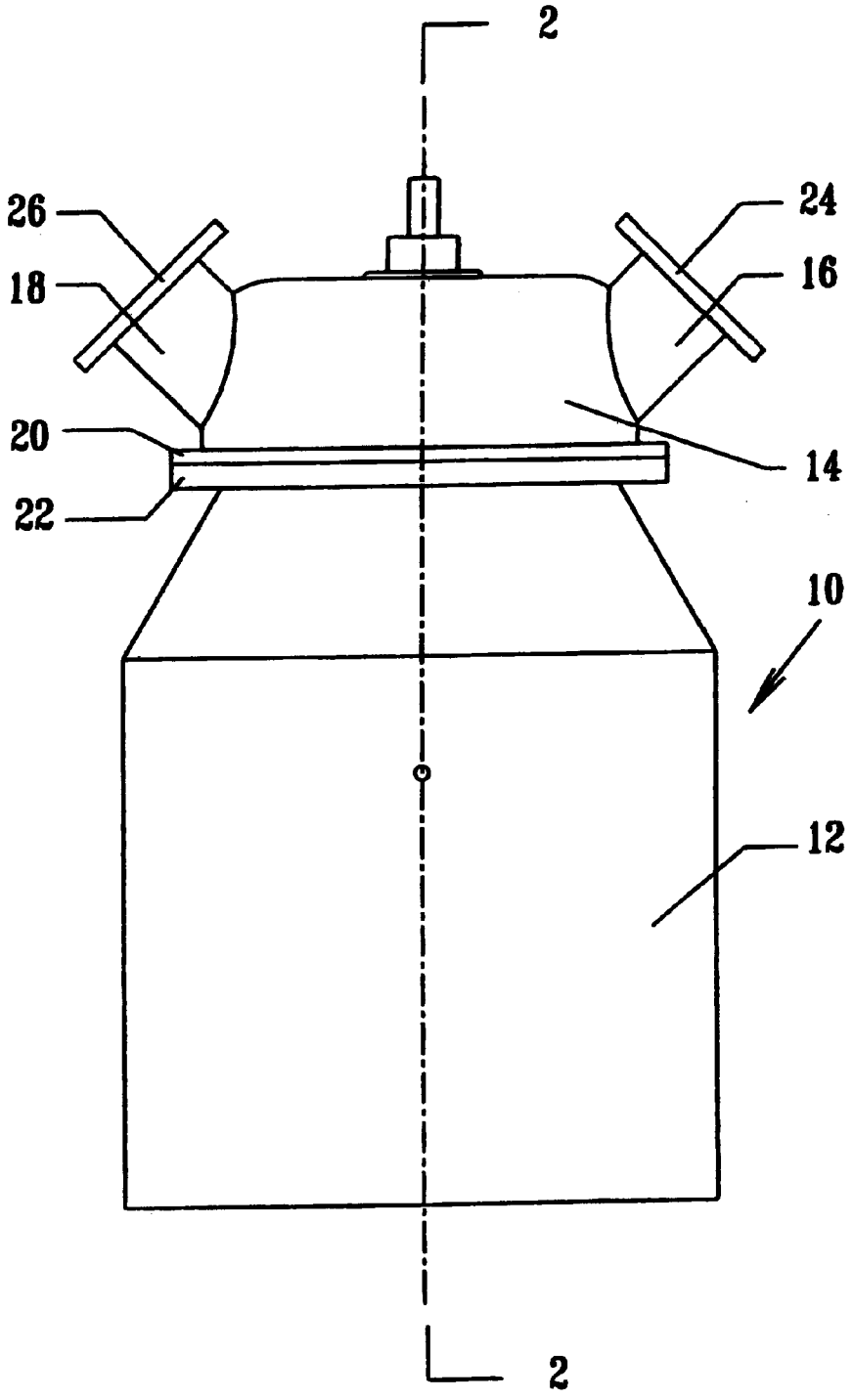
FIG. 1 is an elevational view of a preferred embodiment of the present invention.

Referring to FIG. 1, a catalytic converter 10 in accordance with the invention, comprises a container 12 and valve housing 14 which includes an exhaust gas inlet 16 and an exhaust gas outlet 18. The valve housing 14 has a flange 20 at its bottom end and is mounted to an adapter 22 at the top of the container 12 which will be described below in more detail. The exhaust gas inlet 16 has a flange 24 for the connection of an exhaust gas pipe and the exhaust gas outlet 18 has a similar flange 26 for the connection of a tail pipe. Therefore, exhaust gases that flow through the exhaust gas inlet 16 into the catalytic converter 10 are treated by a catalyst and then discharged to the tail pipe through the exhaust gas outlet 18. It will be understood by those skilled in the art that the angle of orientation of the exhaust gas inlet 16 and the exhaust gas outlet 18 are exemplary only. They may be oriented at other angles and the angles may not be the same.

Figure 2:
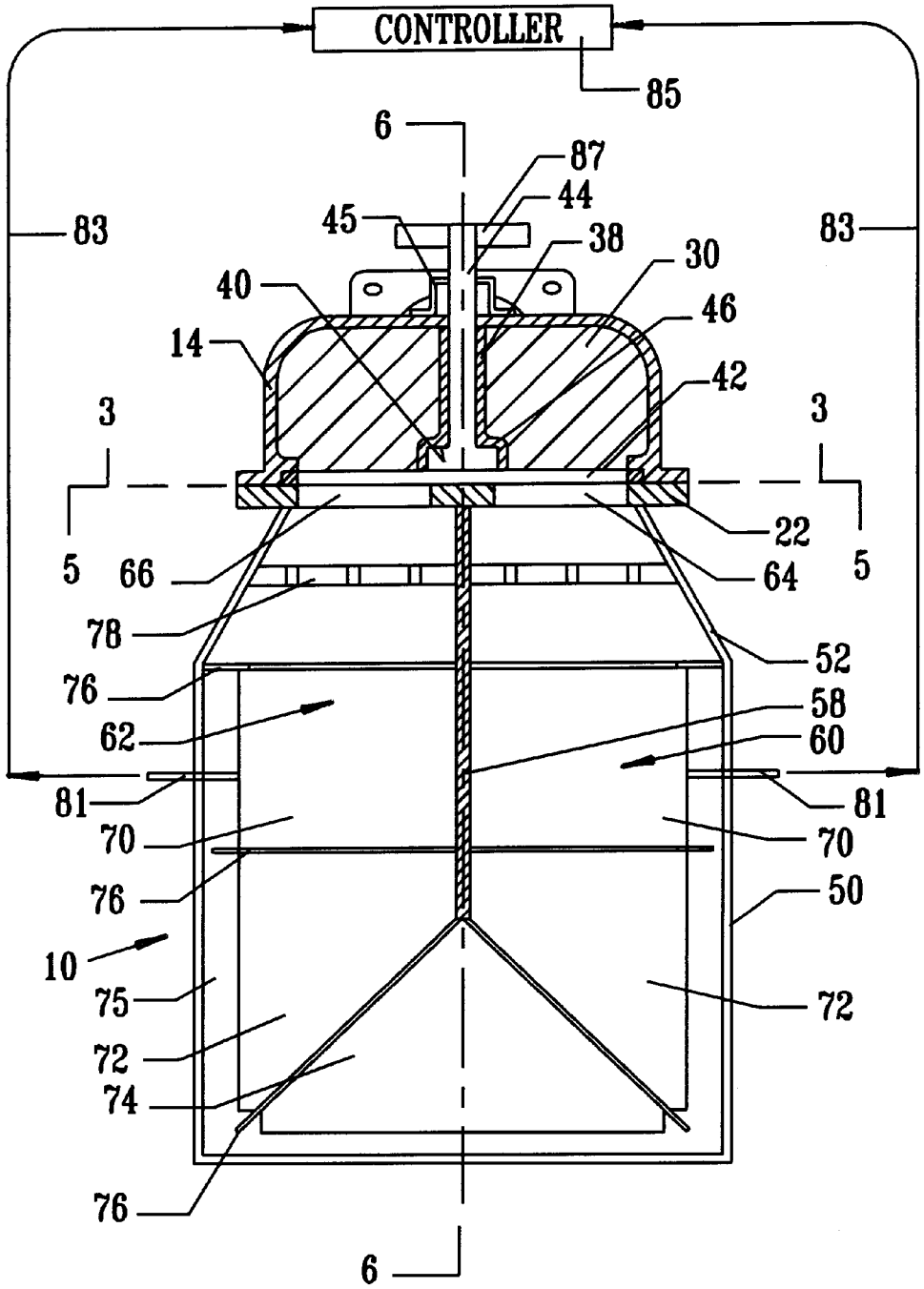
FIG. 2 is a sectional view taken along the line 2—2 of FIG. 1, showing an internal structure of the valve and the catalytic converter.
Figure 3:
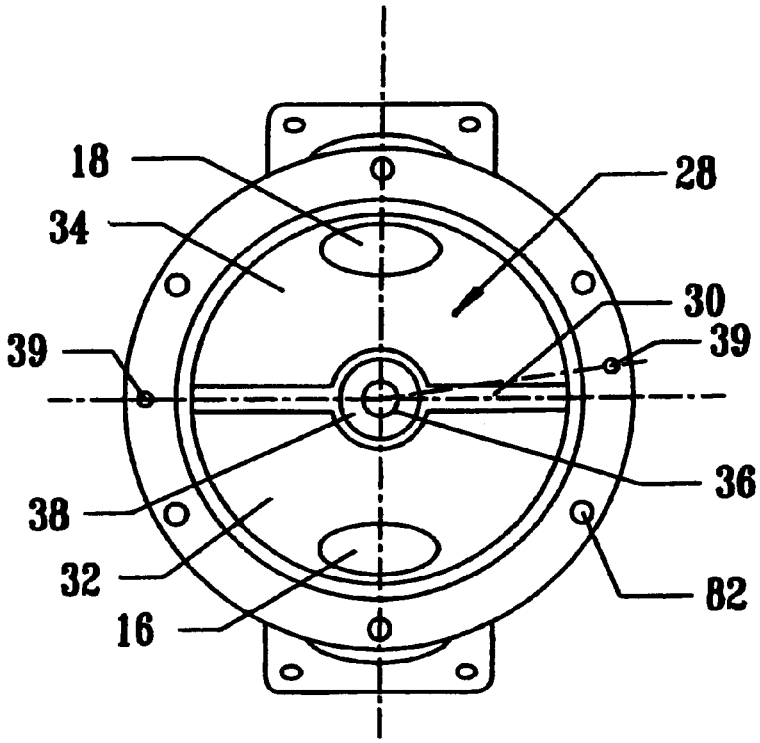

The structure of the catalytic converter is illustrated more clearly in the views shown in FIGS. 2 through 5. The valve housing 14 is circular in plan view and includes an interior cavity with an opening 28 at the bottom end (FIG. 3). A transverse wall 30 divides the interior cavity into two separate sections to form an intake cavity 32 that communicates with the exhaust gas inlet 16 and an exhaust cavity 34 that communicates with the exhaust gas outlet 18. The transverse wall 30 includes two identical halves located on opposite sides of a retainer sleeve 38 which extends from a bore 36 in the top of the valve housing 14 through the transverse wall 30 (see FIG. 2). The transverse wall 30 may be affixed to the valve housing 14, but preferably, the valve housing 14 including the flange 20, the transverse wall 30 and the retainer sleeve 38 are cast as an integral unit. Two locator bores 39 are provided in the flange 20. One of the bores 39 is located on a line which superposes the transverse wall 30 and the other is preferably offset about 5° from the line. The retainer sleeve 38 has an opening extending therethrough with an entrance at the distant end from the top of the valve housing 14. The entrance has a diameter larger than the opening and defines an inner shoulder 40 within the sleeve member 38 the function of which is explained below.

As shown in FIG. 2, a disk plate 42 is rotatably mounted to the bottom end of the valve housing 14. The valve disk 42 has a reciprocal rotary motion about a central axis which is perpendicular to the valve disk 42. A drive shaft 44 is fixed at one end to a centre of the valve disk 42 and extends rotatably through the retainer sleeve 38. A top end of the drive shaft 44 extends from the bore 36 and is rotatably supported by the bore 36. A bracket 45 is mounted to the top of the valve housing 14 to support a rotary actuator (not shown). The drive shaft 44 has an annular step 46 which is received in the enlarged diameter of the retainer sleeve 38 and axially restrained by the inner shoulder 40 of the retainer sleeve 38.

Figure 4:
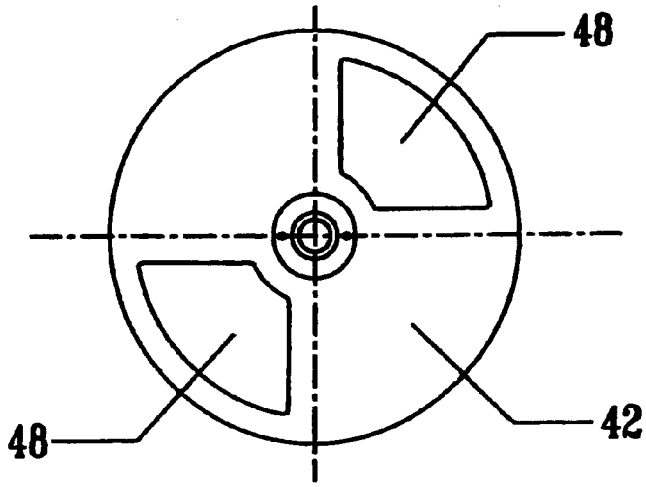
FIG. 4 is a plan view of the valve disk, showing the two openings therein.
Figure 5:
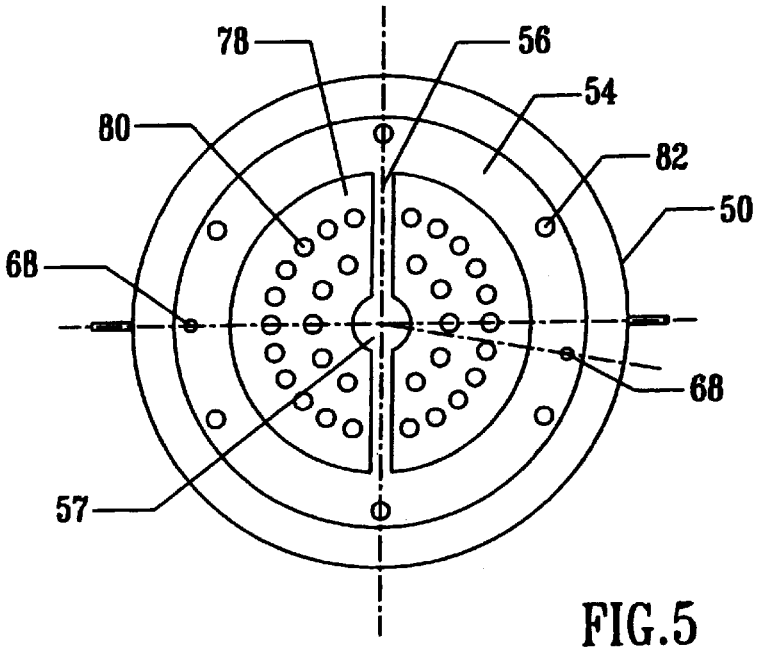
FIG. 5 is a plan view of the container of the catalytic converter taken along the line 5—5 of FIG. 2, showing the position of the transverse plate which separates the interior of the container.

As shown in FIG. 4, the valve disk 42 includes two openings 48. Each opening 48 is slightly smaller than a one quarter section of the valve disk 42. The openings 48 are oriented 180° from each other so that each of the openings 48 communicates with only one of the intake cavity 32 and the exhaust cavity 34 when the valve disk 42 is either in a first position or in a second position. However, when the valve disk 42 is rotated from the first position to the second position, the openings 48 are moved to an opposite side of the transverse wall 30 and thereafter the openings 48 respectively communicate with the other of the intake cavity 32 and exhaust cavity 34. The valve disk 42 may be fixed to the end of the drive shaft 44 by any appropriate fastening mechanism, such as a screw or a bolt.

A sidewall of the container 12 for the catalyst includes a cylindrical portion 50 and a frusto-conical portion 52. The adapter 22 includes a flat ring 54 (FIG. 5) and a diametrical beam 56 connected to the flat ring 54. The beam 56 has a circular central region 57. The adapter 22 is affixed to the top of the frusto-conical portion 52 of the sidewall and supports a transverse plate 58 (FIG. 2) which is affixed to a bottom side of the beam 56 and extends into an interior of the container 12. The transverse plate 58 separates the interior of the container 12 into a first section 60 and a second section 62 that communicate with each other at a bottom end of the container 12 to form a U-shaped exhaust gas passage. The first and second sections 60, 62 respectively communicate with a first port 64 and a second port 66 that are defined by a circular inner surface of the flat ring 54 and the beam 56. A pair of locator bores 68 are provided in the flat ring 54. One of the bores 68 is located on a diametrical line that is perpendicular to the beam 56 and the other is preferably offset by about 5° from the diametrical line. When the valve housing assembly is mounted to a top of the container 12, the two pairs of locator bores 39 and 68, together with a pair of locator pins (not illustrated) which are received in the respective bores, ensure that the transverse wall 30 is positioned at right angles to the beam 56 and the transverse wall 58 so that when the openings 48 are either in the first or the second position, each of the openings 48 communicates with only one of the sections 60, 62 of the container 12 and one of the intake cavity 32 and exhaust cavity 34. Therefore, as the valve disk 42 is rotated from the first to the second position, the openings 48 in the valve disk 42 are moved from one to the other of the intake cavity 32 and the exhaust cavity 34 but keep the same communication with one of the first and second ports 64, 66 respectively to achieve the reversal of gas flow. It should be understood that unidirectional rotation of the valve disk 42 can be used to achieve the same results.

A pair of monolith sections 70 and 72 as well as a single monolith section 74 substantially fill the container as shown in FIG. 2. The shapes of the individual sections of monolith are illustrated in a perspective view in FIGS. 9*a* to 9*c*. However, as will be explained below, the sections of monolith illustrated in FIGS. 9*a* to 9*c* have a graduated cell density, which is yet another feature of the invention. Each section of the monolith 70 is preferably a semi-cylindrical ceramic/metallic extrusion having cells axially extending therethrough. The cell density is preferably 100 cpsi, but the cell density is a matter of design choice. Each section of the monolith 72 is a semi-cylindrical ceramic extrusion having a bottom end that is cut at an angle of about 45°. The monolith 72 also has cells axially extending therethrough. The cell density of the monolith section 72 is preferably 200 cpsi. The monolith section 74 is a ceramic/metallic extrusion which is triangular in front view and may be substantially semicircular in side view. The monolith section 74 preferably has a cell density of 300 cpsi and the cells extend in a direction parallel to a bottom thereof.

The monoliths are respectively coated with catalytic material and arranged in the container 12 in series in the flow passage which is defined by the inner surface of the container 12 and the transverse plate 58. As shown in FIG. 2, the monolith section 74 is positioned at the bottom of the container 12 just beneath the transverse plate 58. Each section of the monolith 72 is located in one of the first and second sections 60 and 62 above the monolith section 74. Each section of the monolith 70 is located in one of the first and second sections 60 and 62, above the monolith section 72. The cells of adjacent pieces of monoliths communicate with each other so that the exhaust gases flowing through the gas flow passage within the container in either direction are drawn through the cells of each monolith section and contact the catalytic material coated on the monoliths. A layer of insulating material 75 such as vermiculite insulation fills a space between the monoliths and the inner surface of the container 12, as well as surrounding the bottom bowl 97. A monolith support 76, such as metal ring or the like, is provided between each section of the monolith to support it.

A buffer plate 78 is located in the frusto-conical portion 52 of the container 12. The buffer plate 78 includes two semi-circular halves located on opposite sides of the transverse plate 58. A plurality of openings 80 in the buffer plate 78 (better illustrated in FIG. 5) permit exhaust gases to pass therethrough. The openings 80 distribute the gas flow evenly across the monolith sections 70. The buffer plate 58 also functions as a muffler to reduce engine noise. The catalytic converter 10 may completely replace a conventional muffler if enough buffer plates having an appropriate configuration are added to a top of the container 12.

Two temperature sensors 81 are located in an upper region of the first and second sections 60, 62 of the container 12 (as shown in FIG. 2). The sensors 81 measure the temperature in each of the sections 60, 62 and send signal 83 to a computerised controller 85 which executes a control algorithm using the temperatures sensed by the sensors 81 as inputs to determine an optimal switching rate and position for the valve disk 42. In response to outputs of the algorithm, the computerised controller operates the rotary actuator 87 mounted to the projecting end of the drive shaft 44 to move the rotating plate 42 from the first to the second position. The rotary actuator may be, for example, a pneumatic or electronic actuator that is commercially available.

In a preferred assembly sequence, the frusto-conical portion 52 is connected to the cylindrical portion 50 after the inner components of the catalytic converter 10 are assembled. The frusto-conical portion 52 may be welded to the cylindrical portion 50 of the container 12. However, it is preferred to removably connect the frusto-conical portion 52 to the cylindrical portion 50. A desirable option is to use an annular V-clamp (not illustrated) to lock together skirted peripheral edges of both frusto-conical and the cylindrical portions in a manner well known in the art.

Figure 6A:
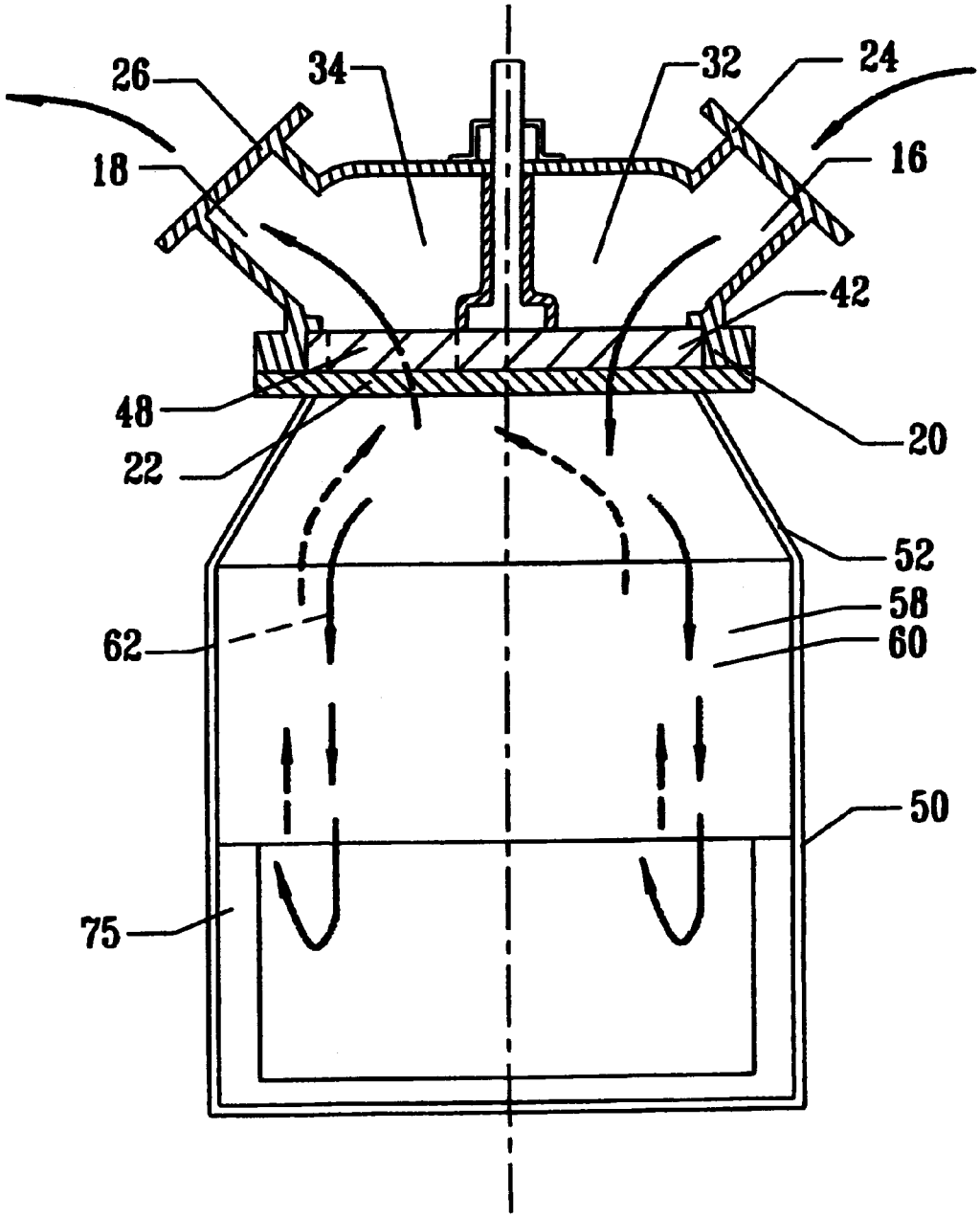
FIG. 6*a* is a cross-sectional view taken along line 6—6 of FIG. 2, showing a direction of gas flow when the valve disk is in a first position.
Figure 6B:
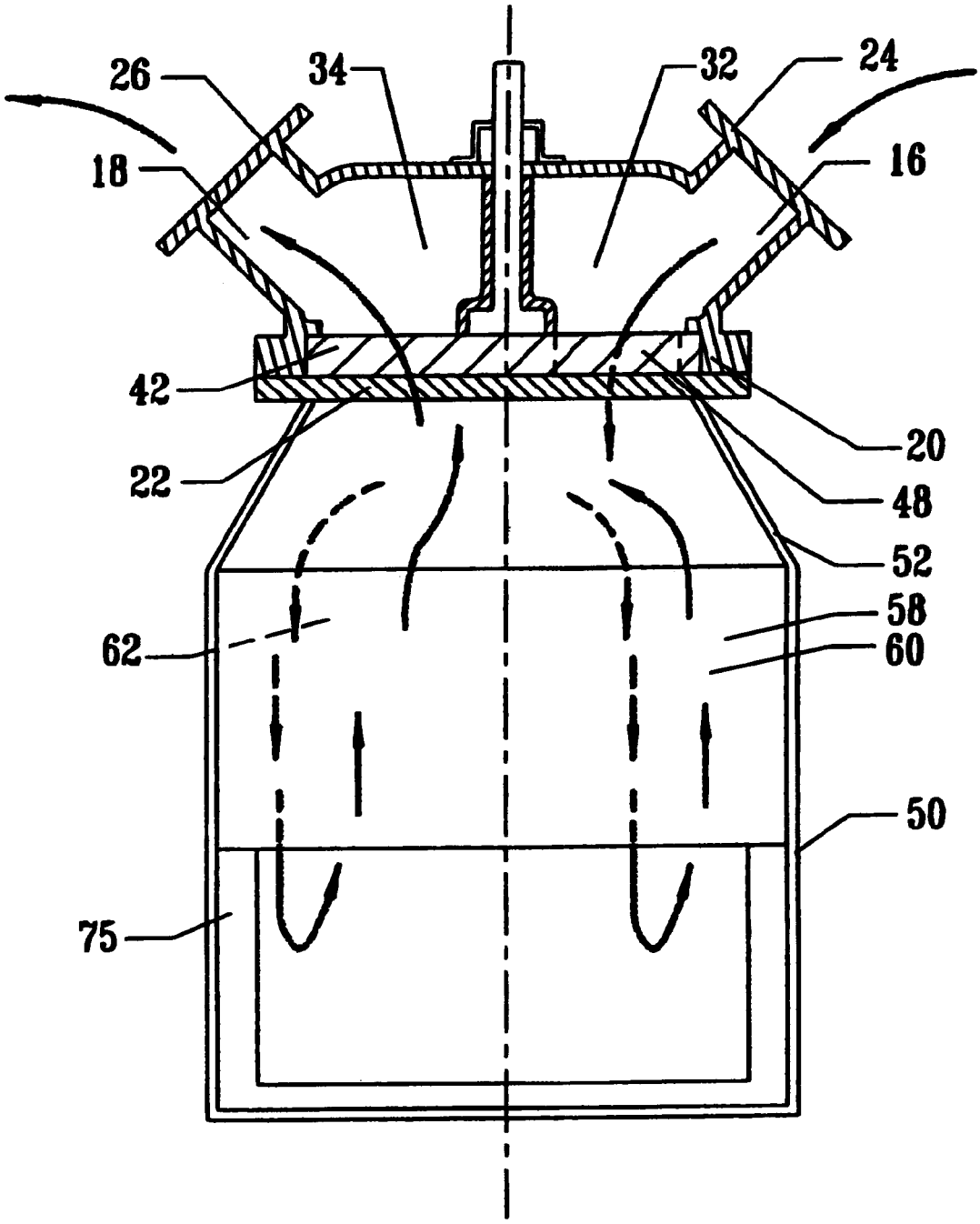
FIG. 6*b* is the same view as FIG. 6*a*, showing a direction of gas flow when the valve disk is in a second position in which the direction of gas flow is reversed.

As shown in FIGS. 6*a* and 6*b*, a gas flow is periodically reversed as it enters the container 12 of the catalytic converter. An axial size of the valve disk 42 is enlarged in both FIGS. 6*a* and 6*b* to clearly show the openings 48 therein. When the valve disk 42 is in the first position, one of the openings 48 in the valve disk 42 is at a left rear side of the exhaust cavity 34 and communicates with the second section 62 which is behind the transverse plate 58. Meanwhile, the other one of the openings 48 in the plate 42 is at the right front side of the intake cavity 32 and communicates with the first section 60 which is in the front of the transverse plate 58. The solid arrows in FIG. 6*a* show that the exhaust gases from the engine are introduced in the exhaust gas inlet 16 and enter the intake cavity 32, pass through the other one of the openings 48 at the right front (not shown), downwardly into the first section 60 of the container 12, passing through the catalytic monoliths (not shown) therein. When the exhaust gases reach the bottom of the container 12, they enter the second section 62 of the container. The broken arrows in FIG. 6*a* show that the exhaust gases that entered the second section 62 of the container 12 flow upwardly and through the one of the openings 48 which is at the left rear and enter the exhaust cavity 34. The exhaust gases are then discharged to a tail pipe via the exhaust gas outlet 18.

When the valve disk 42 is in the second position, the openings 48 in the valve disk 42 are rotated 90° from their location in the first position. As shown in FIG. 6*b* in the second position the opening 48 in the intake cavity 32 is at the right rear and communicates with the second section 62 which is behind the transverse plate 58. The other of the openings 48 in the valve disk 42 is on the left front of the transverse plate 58. In that position the exhaust cavity 34 communicates with the first section 60, which is at the front of the transverse plate 58.

The broken arrows in FIG. 6*b* show that the exhaust gases having entered the intake cavity 32 flow through one of the openings 48 at the right rear and downwardly into the second section 62 of the container 12, passing through the catalytic monoliths (not shown), reaching the bottom of the container 12 and entering the first section 60. The solid arrows in FIG. 6*b* show that the exhaust gases in the first section 60 flow upwardly and through the other one of the openings 48 which is at left front and enter the exhaust cavity 34. The exhaust gases are then discharged to a tail pipe via the exhaust gas outlet 18. By moving the valve between the first and the second position at intervals determined by the controller, a desired temperature profile will develop along the series of the catalyst monoliths 70–74.

The exhaust gases pass through the monoliths 70, 72 and 74 in alternating directions, contacting the catalytic material. The monolith 70 has, for example, a lower cell density of 100 cpsi, its heat capacity is therefore higher and the monolith is better protected from thermal stress. A monolith with low cell density and high heat capacity is able to withstand exposure to high temperature exhaust gases in the upstream of the exhaust gas flow. When the exhaust gases flow into monoliths 72 and 74 which have higher cell density, they are exposed to more catalyst and the conversion performance is therefore more efficient. As the exhaust gases flow through in the monoliths 70, 72 and 74 in both of the first and second sections 60, 62 and reach the top of the container 12, a large proportion of the noxious substances in the exhaust gases are converted into innocuous substances.

Figure 7B:
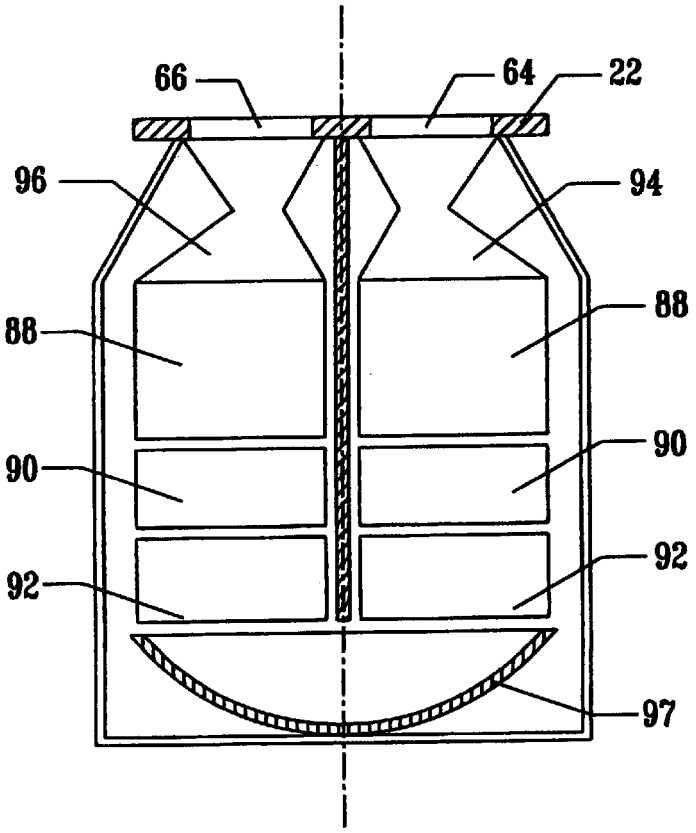
FIG. 7*a* to FIG. 7*d* are diagrams showing different arrangements for monoliths in various embodiments of the invention, FIG. 7*a* appears on sheet 9 and FIG. 7*b* appears on sheet 4 of the drawings.
Figure 7A:
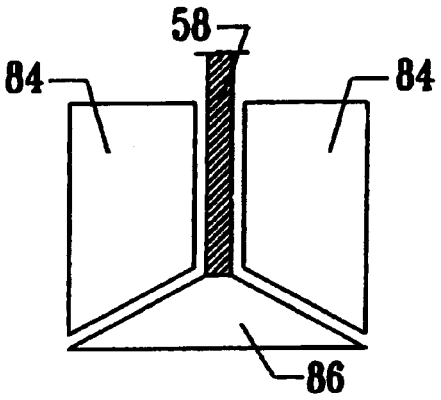

FIG. 7*a* shows an alternate arrangement of the monolith series that includes two monolith sections 84 having a cell density of 100 cpsi and one monolith section 86 having a cell density of 300 cpsi.

FIG. 7*b*, is a schematic diagram which shows another arrangement of the monolith series that includes 3 pairs of monoliths. In one example of the arrangement monolith 88 has cell density of 100 cpsi. Monolith 90 has a cell density of 200 cpsi and monolith 92 has a cell density of 300 cpsi. The cell densities of the monoliths 88, 90 and 92 may be in other combinations such as 200, 300, 400, or 200, 300, 300. Instead of using a buffer plate to distribute gas flow within the container 12, two venturis 94 and 96 are provided to achieve the same function. A spherically shaped bottom bowl 97 is provided to direct the gas flow smoothly from the first section to the second section and vice versa.

Figure 7C:
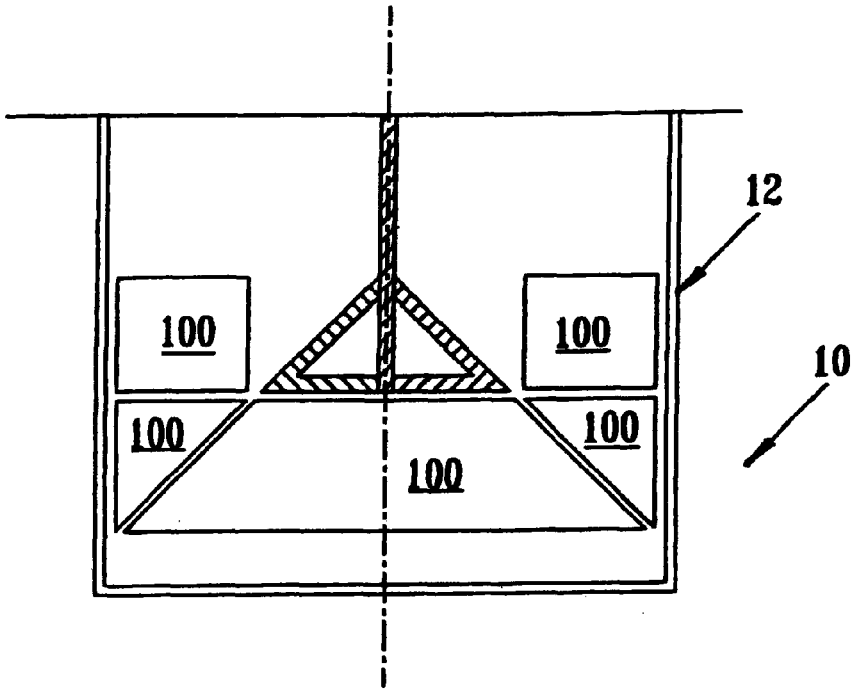
Figure 7D:
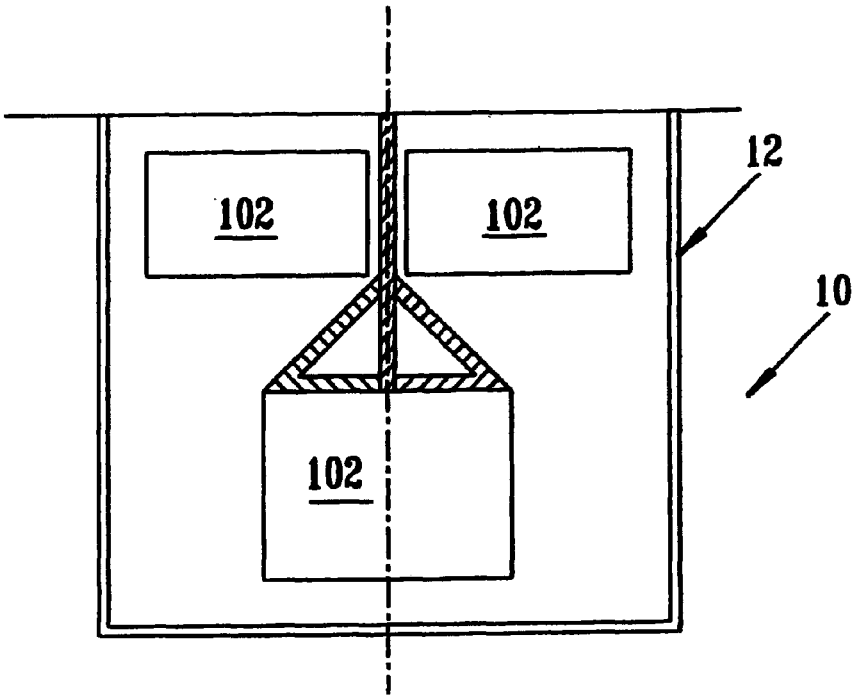

FIG. 7*c* and FIG. 7*d* are schematic diagrams of two more potential arrangements for monoliths. The arrangement in FIG. 7*c* may be applied in a large catalytic converter. Instead of using large monolith sections, monoliths 100 are divided into small sections. Monoliths in small sections are usually more readily available through normal commercial channels. The monoliths 102 used in FIG. 7*d* are simpler in shape than the monoliths 72 and 74 used in the preferred embodiment of the invention.

Figure 8:
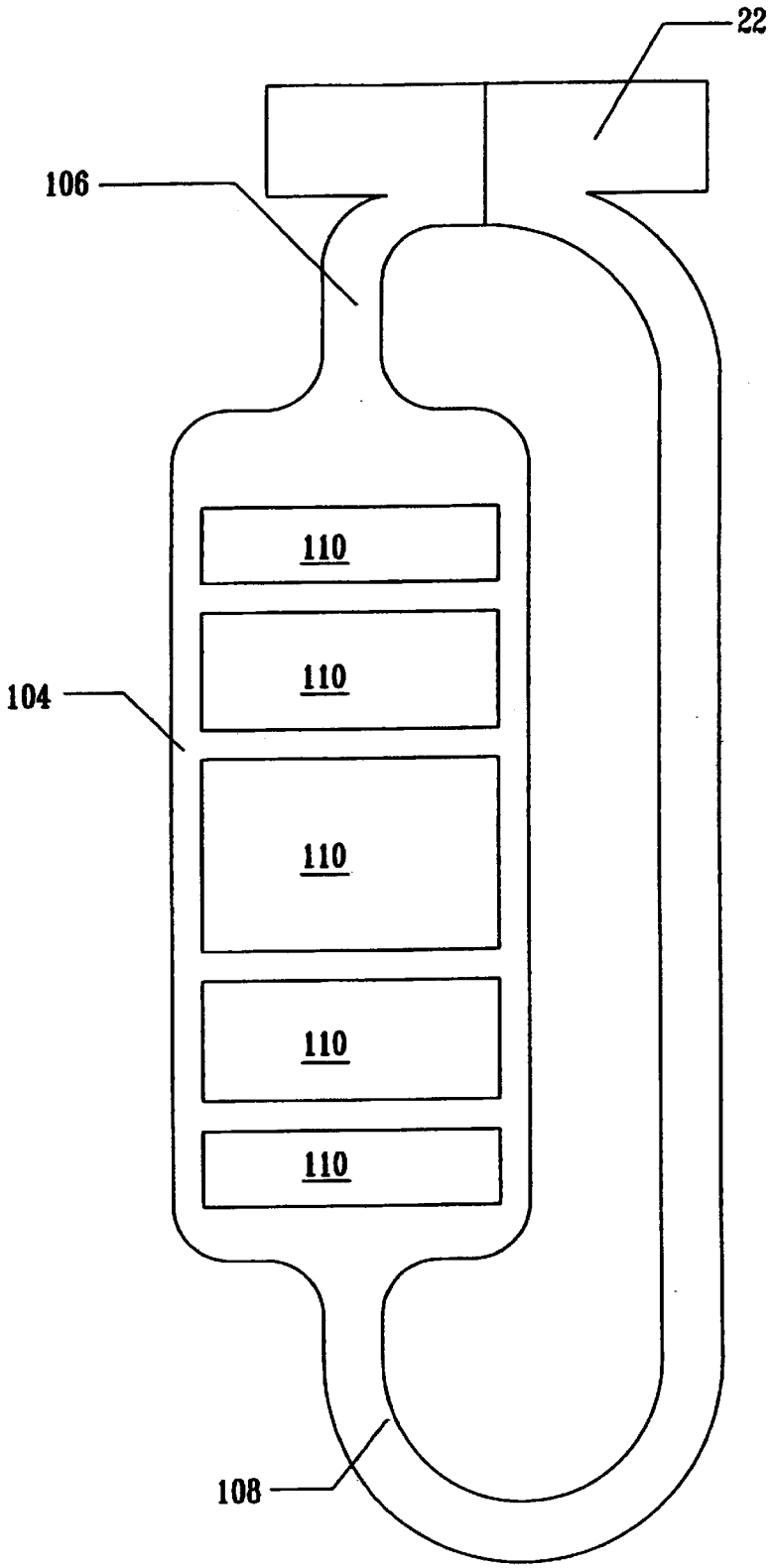
FIG. 8 is a schematic side view of another embodiment of the invention.

FIG. 8 is a schematic diagram of a converter 104 with monoliths 110, having its first and second ports 106 and 108 at opposite ends, which is an arrangement similar to conventional converter containers. This diagram illustrates how to use the adapter 22 to mount the valve unit of the present invention onto a converter container having the ports at opposite ends.

Figure 9A:
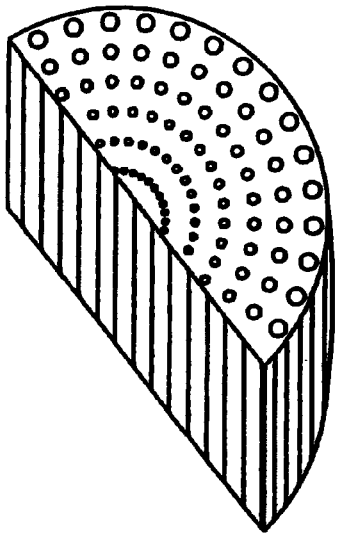
FIG. 9*a* to FIG. 9*c* are perspective views of monoliths used in the preferred embodiment but with graduated densities.
Figure 9C:
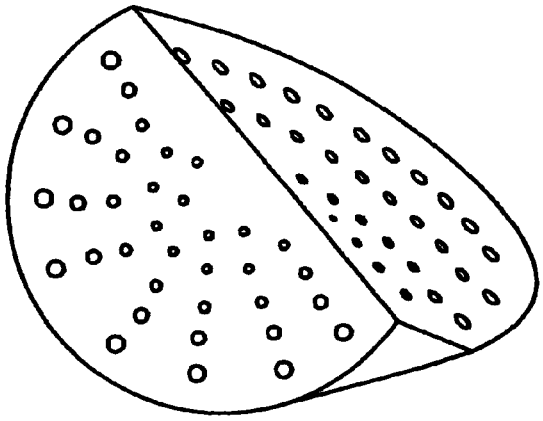
Figure 9B:
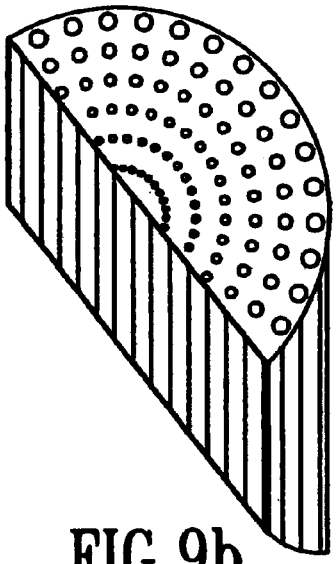

FIGS. 9*a* to 9*c* show monoliths shaped like those used in the preferred embodiment of this invention, but with a unique cell structure. Each monolith has a radially graduated cell density which decreases from 400 cpsi in a region near a center of the container to 100 cpsi in a region near an outside wall of the container. As seen in FIG. 2, the gas flow passages adjacent to the transverse plate 58 are shorter than the passages adjacent to the wall of the container 12. The monolith shown in FIGS. 9*a–c* promotes better conversion of the exhaust gases because the shorter passageway has a higher cell density and the catalytic conversion performance is therefore more balanced. An adsorbent material may also be deposited on the monoliths. The adsorbent material adsorbs pollutants during an engine start-up period before the catalyst ignites and release them as temperature rises.

The advantages of the catalytic converter described above are apparent. No plumbing is required between the converter unit and the valve unit, which makes the catalytic converter compact and inhibits heat loss between the valve and the catalyst. The valve disk is rotated about a perpendicular axis, which provides smooth and reliable valve operation in a minimum of space. The unique arrangement of the monolith series improves catalyst life and conversion performance. And, the reversing exhaust gas flow ensures maximum efficiency of conversion by keeping the catalytic material uniformly heated to light off/ignition temperatures.

We claim:

1. A valve structure for a reversing flow catalytic converter for exhaust gases, the converter having a container which has a top end with a first port and a second port which are in fluid communication with each other so that the exhaust gases introduced into the first and second ports flows through a stationary catalytic material in the container, comprising:

a valve housing including an intake cavity and an exhaust cavity, adapted to be mounted on the top end of the container, the intake cavity being adapted for connection of an exhaust gas pipe and the exhaust cavity being adapted for connection of a tail pipe;

a valve component operably mounted in the valve housing for reversing gas flow through the stationary catalyst, the valve component being adapted to be moved between a first position in which the intake cavity communicates with the first port and the exhaust cavity communicates with the second port so that a gas flow passage is enabled through the stationary catalyst in a first direction, and a second position in which the intake cavity communicates with the second port and the exhaust cavity communicates with the first port so that a gas flow passage is enabled through the stationary catalyst in a second direction opposite the first direction.

2. A valve structure as claimed in claim 1 wherein the valve housing has an interior cavity with open bottom and a transverse wall dividing the cavity into two halves which respectively form the intake cavity and the exhaust cavities.

3. A valve structure as claimed in claim 2 wherein the valve component includes:

a solid disk which is rotatably mounted to the valve housing at the open bottom, and rotates about a central axis that is perpendicular to the disk, the disk having a first opening and second opening therethrough which alternately communicate with the respective ports, and one of the intake and exhaust cavity.

4. A valve structure as claimed in claim 3 wherein the first and second ports are substantially semi-circular in plan view and the intake and exhaust cavities are also substantially semi-circular in cross-section but offset at 90° with respect to the ports.

5. A valve structure as claimed in claim 4 wherein the semi-circular shape of the intake and exhaust cavities and the semi-circular shape of the ports are substantially identical, and each of the openings in the valve disk is slightly smaller than half the size of the semi-circular shape of the ports, the openings in the disk being oriented 180° with respect to each other.

6. A valve structure as claimed in claim 5 wherein the disk further comprises a drive shaft affixed to the central axis, extending axially through the valve housing with one end projecting from a top of the valve housing.

7. A valve structure as claimed in claim 6 further comprising a rotary actuator operably associated with the drive shaft at the projecting end.

8. A valve structure as claimed in claim 7 wherein the valve housing further comprises a mechanism for accurately positioning the valve housing on the top of the container and removably securing the same so that the transverse wall is offset at 90° with respect to the ports.

9. A catalytic converter for treating exhaust gases from an internal combustion engine using a catalytic converter comprising:

a container having a gas flow passage therein and a top end having a first port and a second port which communicate with the passage respectively;

a stationary catalytic material in the gas flow passage adapted for contacting the exhaust gases which flow through the passage;

a valve for reversing an exhaust gas flow through the gas flow passage, including a valve housing with an intake cavity and an exhaust cavity, mounted on the top end of the container, the intake cavity being adapted for connection of an exhaust gas pipe and the exhaust cavity being adapted for connection of a tail pipe;

a valve component operably mounted in the valve housing for reversing gas flow through the stationary catalyst, the valve component being adapted to be moved between a first position in which the intake cavity communicates with the first port and the exhaust cavity communicates with the second port so that a gas flow passage is enabled through the stationary catalyst in a first direction and a second position in which the intake cavity communicates with the second port and the exhaust cavity communicates with the first port so that a gas flow passage is enabled through the stationary catalyst in a second direction opposite the first direction.

10. A catalytic converter as claimed in claim 9 wherein the gas flow passage is formed within an interior chamber of the container, the interior chamber being separated by a transverse plate into two halves which form respectively a first chamber section and a second chamber section, the two chamber sections communicating with each other, each of the chamber sections communicating with a corresponding one of the first and second ports.

11. A catalytic converter as claimed in claim 10 wherein the container further comprises a gas permeable solid material which supports the catalytic material.

12. A catalytic converter as claimed in claim 11 wherein the gas permeable solid material comprises a plurality of monoliths which respectively have a plurality of cells extending therethrough, the monoliths being coated with catalytic material.

13. A catalytic converter as claimed in claim 12 wherein the plurality of monoliths are positioned in series in the passage, the cells in each monolith communicating with the cells in an adjacent monolith.

14. A catalytic converter as claimed in claim 13 wherein the monoliths have different cell density, a cell density of the monoliths positioned close to each end of the series being less than the density of monoliths positioned therebetween.

15. A catalytic converter as claimed in claim 13 wherein each of the monoliths has a cell density which varies radially in cross-section from a high cell density in a region near a center of the container to a low cell density in a region near an outside wall of the container.

16. A catalytic converter as claimed in claim 12 wherein the container further comprises at least one buffer plate between the ports and monoliths.

17. A catalytic converter as claimed in claim 9 wherein the valve housing comprises an interior cavity with an opening in a bottom thereof and a transverse wall that divides the cavity into two halves which respectively form the intake cavity and the exhaust cavities.

18. A catalytic converter as claimed in claim 17 wherein the valve component includes a solid disk which is rotatably mounted to the valve housing at the opening in the bottom thereof and rotates about a central axis that is perpendicular to the disk, the disk having a first opening and second opening therethrough which alternately communicate with respective ones of the ports in each of the first and second positions, and one of the intake and exhaust cavities.

19. A catalytic converter as claimed in claim 18 wherein the container has an opening at the top, the opening being divided by the transverse plate into two parts which form the first and second ports, respectively, the valve housing of the valve being mounted on the top of the container in a position so that the transverse plate is perpendicular to the transverse wall.

20. A catalytic converter as claimed in claim 19 wherein the valve disk is positioned between the transverse wall and transverse plate, the valve disk being perpendicular to both the transverse wall and the transverse plate, and each of the two openings in the valve disk is smaller than a quarter section of the first and second ports.

21. A catalytic converter as claimed in claim 20 wherein the disk further comprises a drive shaft superposing the central axis, extending axially through the valve housing with one end projecting from a top of the valve housing.

22. A catalytic converter as claimed in claim 21 further comprising a rotary actuator operably associated with the drive shaft at the projecting end.

23. A catalytic converter as claimed in claim 22 further comprising a mechanism for accurately positioning the valve on the top of the container and removably securing the same so that the transverse wall is offset at 90° with respect to the ports.

24. A catalytic converter as claimed in claim 23 further comprising a sensor device for measuring temperatures of the exhaust gases in the gas flow passage.

25. A catalytic converter as claimed in claim 24 further comprising a controller for controlling the rotary actuator to rotate the drive shaft periodically according to temperatures measured by the sensor device.

* * * * *